US006050262A

United States Patent [19]

Jay

[11] Patent Number: 6,050,262

[45] Date of Patent: Apr. 18, 2000

[54] OVERPRESSURE VENTILATION DEVICE FOR A GAS MASK

[75] Inventor: Christian Jay, Saint Etienne, France

[73] Assignee: Giat Industries, France

[21] Appl. No.: 09/111,780

[22] Filed: Jul. 8, 1998

[30] Foreign Application Priority Data

Jul. 22, 1997 [FR] France ..... 97 09278

[51] Int. Cl.[7] ..... A62B 7/10; A62B 18/02; A62B 18/08

[52] U.S. Cl. ..... 128/205.27; 128/205.12; 128/205.25; 128/206.12; 128/206.17; 128/205.29

[58] Field of Search ..... 128/205.12, 205.25, 128/205.29, 206.12, 206.17, 206.28, 205.27

[56] References Cited

U.S. PATENT DOCUMENTS 3,629,868 12/1971 Greenlee ..... 128/205.25
4,320,755 3/1982 Flint et al. ..... 128/205.12
5,372,130 12/1994 Stern et al. ..... 128/205.25
5,404,874 4/1995 Meier .

FOREIGN PATENT DOCUMENTS 0164946 12/1985 European Pat. Off. .
2222777 3/1990 United Kingdom .

*Primary Examiner*—John G. Weiss
*Assistant Examiner*—Todd Martin
*Attorney, Agent, or Firm*—Parkhurst & Wendel, L.L.P.

[57] ABSTRACT

An overpressure ventilation device for a gas mask air filter integrated into a case closed by a lid, formed of a caseless centrifugal ventilator connected before the filter, wherein it comprises a support integral with the filter lid enabling the motor and ventilator fan wheel to be centered on the longitudinal axis of the filter, such as to obtain the axial operation of the ventilator. The lid is provided with a well in which to receive the support, which comprises a first lateral wall cooperating with the connection means, a second lateral wall prolonging the first one and a bottom wall provided with apertures to let the air through.

10 Claims, 3 Drawing Sheets

25
26
28
27
A
A
20
18
5
4
1

16
15
3
29
18
17
18

OVERPRESSURE VENTILATION DEVICE FOR A GAS MASK

BACKGROUND OF THE INVENTION

The technical scope of the present invention is that of face mask air filters fitted with a ventilation system creating an overpressure in the mask.

It is well known for the air filter of a face mask to hinder head movements due to its mass and volume. An improvement to the wearing of such a mask has already been considered by creating an overpressure with the addition of a ventilator before the filter. Ventilation reduces the respiratory difficulties and offers additional safety protection because of the overpressure it creates. Patent U.S. Pat. No. 5,404,874 thus proposes a centrifugal ventilator fitted with an electric motor which draws in the air through an aperture in a case and directs it towards the face mask filter by means of a three-branched adaptor enabling it to be attached to the filter. The disadvantage of this device lies in the fact that it is easy to pull off and is rather cumbersome. Moreover, because of its design, this device can only be adapted to one type of filter which necessarily possesses a metal frame.

SUMMARY OF THE INVENTION

The aim of the present invention is to propose a ventilation device for a filter of a gas mask which does not present the disadvantages mentioned above and which is, moreover, integrated into the filter support.

The subject of the invention is thus an overpressure ventilation device for a gas mask air filter integrated into a case closed by a lid, formed of a voluteless centrifugal ventilator connected before the filter, wherein it comprises a support integral with the filter lid enabling the motor and ventilator fan wheel to be centered on the longitudinal axis of the filter, such as to obtain the axial operation of the ventilator.

According to another characteristic of the invention, the lid is provided with a well in which to receive the support, which comprises a first lateral wall cooperating with the connection means, a second lateral wall prolonging the first one and a bottom wall provided with apertures to let the air through.

According to yet another characteristic of the invention, strips are fastened to the second lateral wall and to the bottom to channel the air towards the outlet apertures.

The support is formed of a cap to center the motor fitted in a removable manner onto the lid.

According to another characteristic, a deflector is placed between support and fan wheel.

Generally speaking, the cap is in the shape of a substantially cylindrical element prolonged by a lateral wall fitted with means to connect it to the lid.

The lateral wall of the cap is fitted with air inlets and is prolonged on the inside by a fold marking out the deflector.

According to one embodiment, the ventilation device comprises:

- a first chamber marked out by the lateral wall and the deflector,
- a second chamber marked out by the motor and the blades of the ventilator fan wheel, and
- a third chamber marked out by the deflector, the lid and the ventilator fan wheel.

The lateral wall of the cap and the deflector mark out an observation window for the fan wheel.

The lower edge of the fan wheel is fastened rigidly to the shaft of the motor supported by a bearing, said shaft being aligned along axis B of the filter.

One advantage of the present invention lies in the reduced bulk of the device and the reduced number of parts required to make it, thereby causing a reduced mass.

A further advantage of the invention lies in the axial assembly of the ventilator which makes the whole assembly very compact.

Another advantage of the invention lies in the reduction of the likelihood of the device separating from its filter during head or arm movements of the wearer when moving or in his different work positions.

Other characteristics, advantages and particulars of the invention will become more apparent after reading the additional description which follows of an embodiment given by way of illustration in relation to the drawings.

DESCRIPTION OF THE PREFERRED EMBODIMENTS

Figure 1:
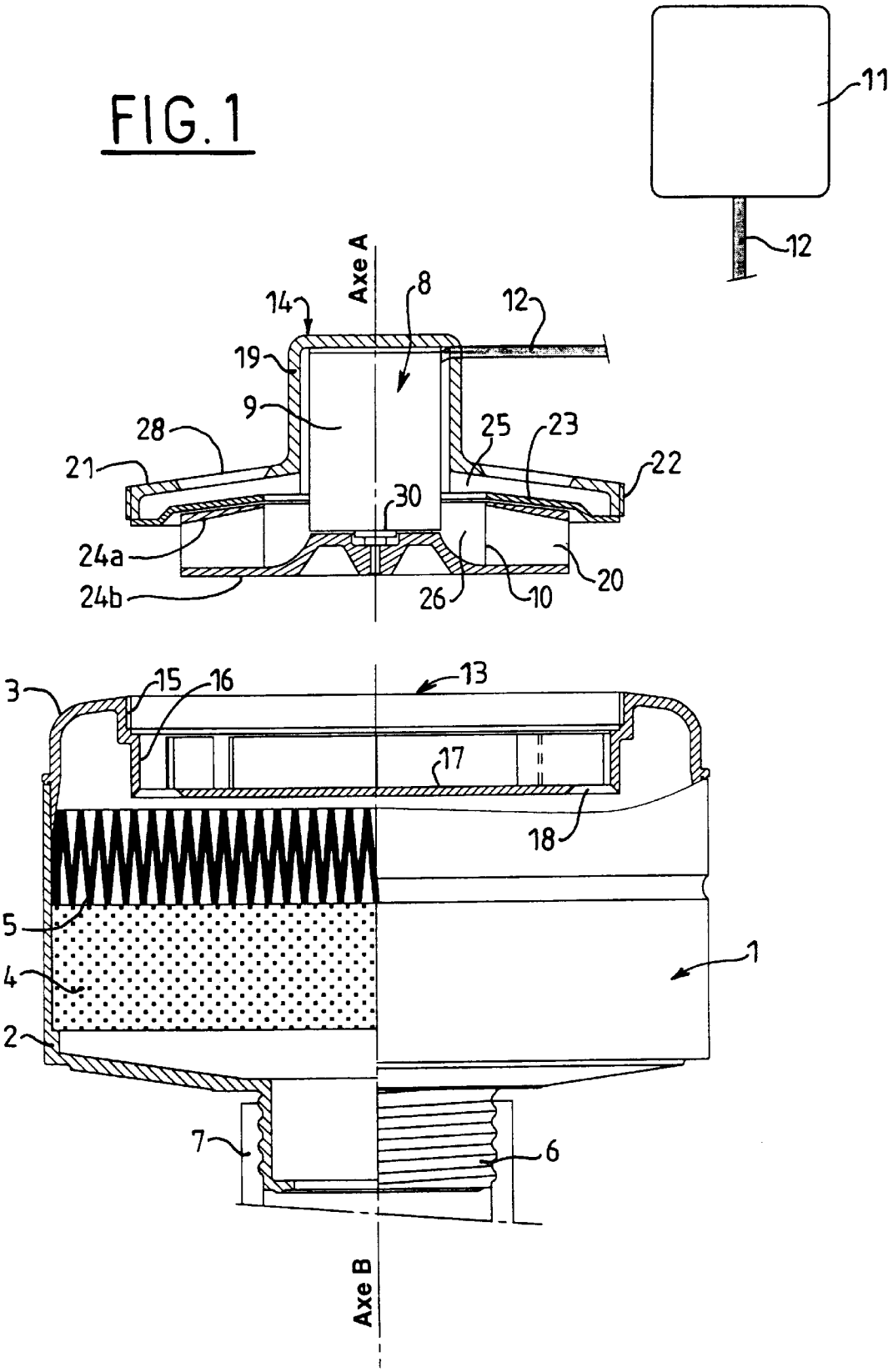
FIG. 1 is a longitudinal section of the filter.
Figure 2:
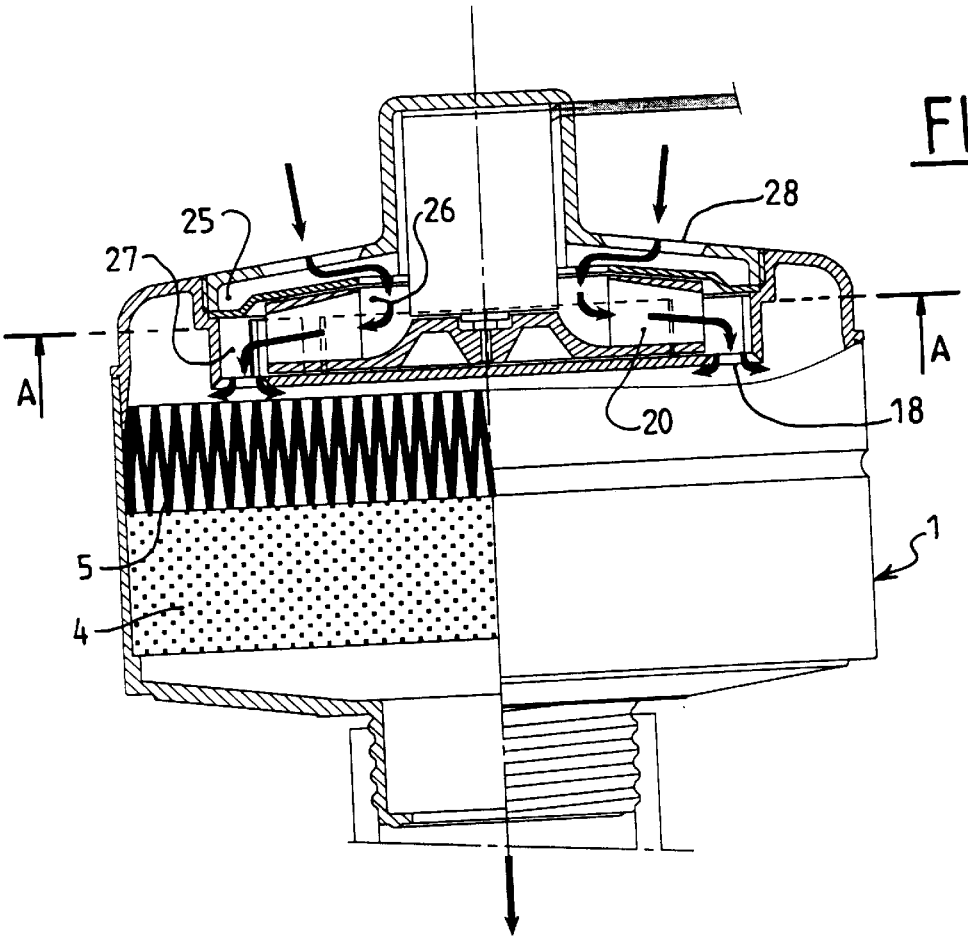
FIG. 2 shows the air circulation in the device according to the invention.

On the longitudinal section of filter 1 shown in FIGS. 1 and 2, we see that this is formed conventionally of a casing 2 closed by a lid 3, enclosing a filtration system formed here by a cassette 4 of activated charcoal and a paper filter 5. This filter 1 is screwed on using a threaded connector 6 on joining part 7 of the gas mask. Filter 1 has an axis B of longitudinal symmetry. According to the invention, a ventilator 8 is placed at lid 3 formed of a motor 9 and a fan wheel 10, and which is supplied by a battery 11 by means of an electrical link 12. Lid 3 marks out a well 13 receiving a support 14 of ventilator 8. Well 13 comprises a first tubular part 15 prolonged by a second tubular part 16 with a smaller diameter, which are aligned along axis A, such axis being the same as axis B, and a bottom 17 perforated with apertures 18. Support 14 is formed by a cap 19 and is in the shape of a substantially cylindrical element prolonged by a lateral wall 21 cooperating with tubular part 15 to fasten cap 19 to lid 3, using connection means 22, for example threading, or a quarter twist or clip system. The assembly described above is completed by a deflector 23 which, with bottom 17 of the lid, marks out a housing inside which wheel 10 turns. This deflector 23 can be made either in the form of a separate part fastened at its periphery to lateral wall 21, or in the form of a fold of lateral wall 21 itself. Fins 20 of fan wheel 10 have a curved profile, and in FIG. 1 we see the upper edge 24*a* and lower edge 24*b* of each of them. The ventilation device comprises a chamber 25 marked out by deflector 23 and wall 21, a chamber 26 marked out by blades 20 of fan wheel 10 and lower edge 24*b* of fan wheel 10, chamber 27 marked out by fan wheel 10 and tubular part 16 of the lid. Chamber 27 opens out into apertures 18 to bring air into the filtration system. Wall 21 is perforated by a certain number of air inlet apertures 28.

It is important to note that fan wheel 10 of the ventilator is fastened rigidly, by its lower edge, to the shaft of the motor supported by bearing 30.

In FIG. 2, the circulation of the air flow has been shown using arrows from the outside atmosphere. When the ventilator operates, the air is drawn in through apertures 28 and flows into chamber 25, then into chamber 26 and is forced axially under the action of the ventilator into chamber 27. In said chambers, the air is then directed inside the filter through apertures 18, then towards the face mask. The air thus drawn in covers a relatively short distance and flows in an overpressure thus facilitating respiration for the user of the face mask.

Figure 3:
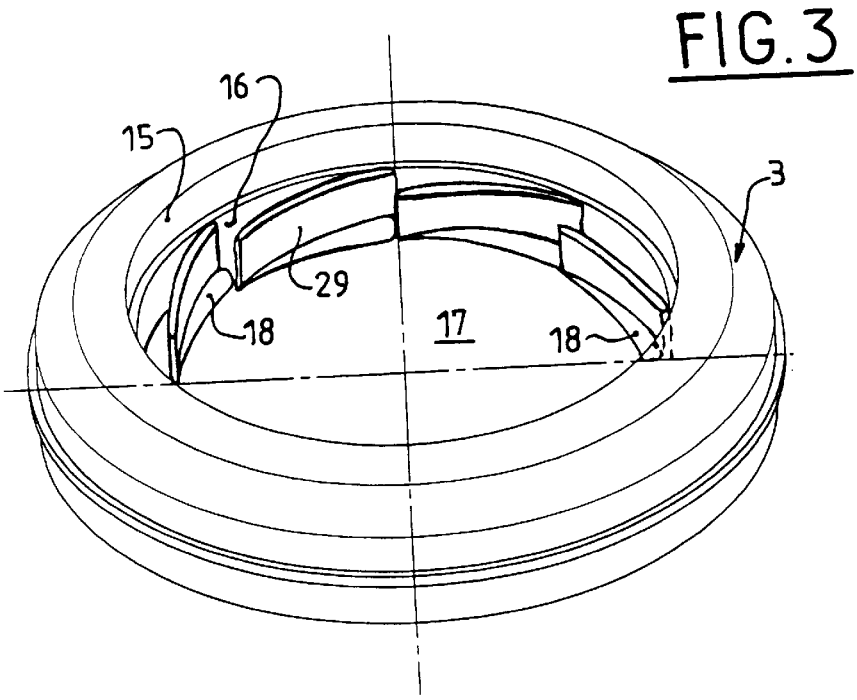
FIG. 3 is a top perspective view of the lid.

In FIG. 3, a perspective view of the lid shows strips 29 integral with wall 16 and bottom 17. These strips have a curved profile and are used to channel the air coming radially from fan wheel 10 in order to force it axially towards filter 5. These strips 29 can be moulded directly during manufacture of the lid if the latter is made of a plastic material.

Figure 4:
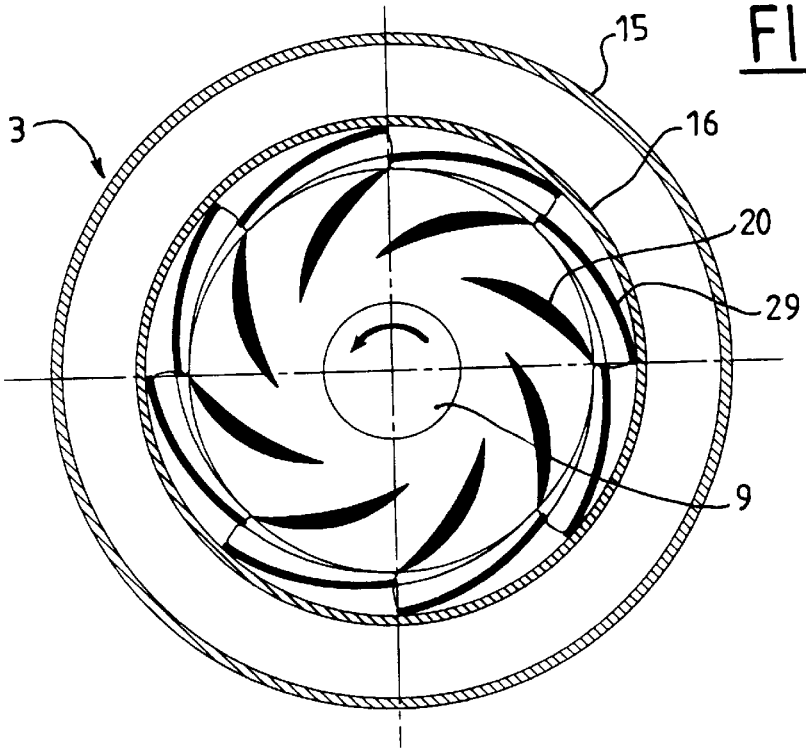
FIG. 4 is a section along A—A in FIG. 1 showing the ventilator fan wheel.

In FIG. 4, which is a section view along A—A in FIG. 1, we see lid 3, tubular part 16, strips 29 of said lid and blades 20 of the fan wheel driven by motor 9. Strips 29 send the pressurized air into chamber 27 via chamber 26 as indicated previously.

Figure 5:
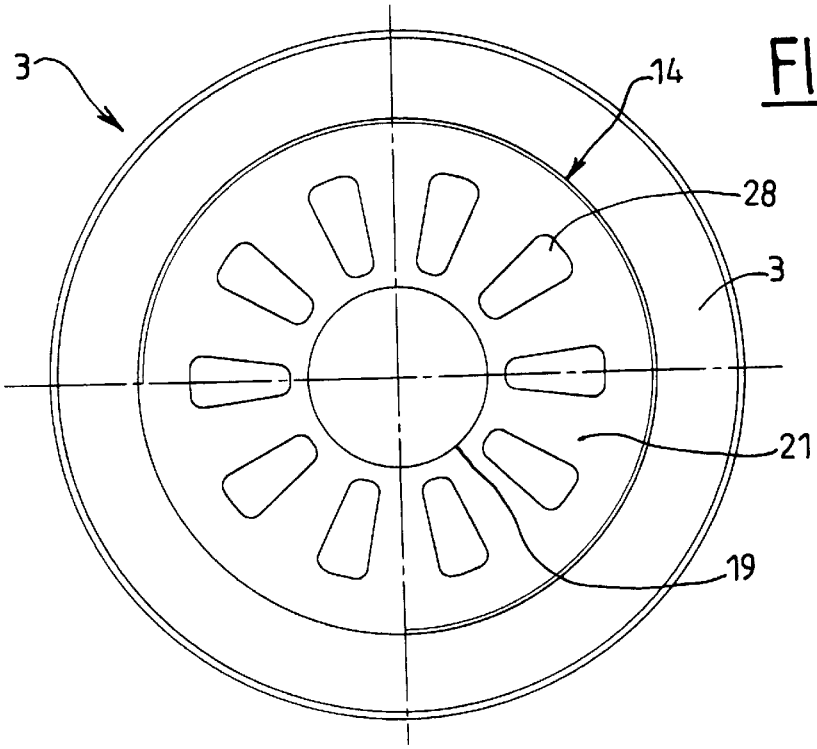
FIG. 5 is a top view of the lid.

FIG. 5 shows a top view of the ventilation device showing apertures 28 of lid 3 in which wall 21 prolonged by cap 19 has been inserted.

It is important to note that the face mask can be used when the ventilator is off or when it has been removed. In this event, the respiration assistance function does not exist and the user must overcome the loss of potential of the whole filtration system by his own respiration.

Case 2 is shown schematically and electrical link 12 is fitted with a plug to connect it to this casing. The casing is carried by the user and the ventilator is activated by introducing the plug into the battery case or else by activating a switch.

Once again it is important to note that the ventilator works by force-back being placed at the air filter inlet. The airtightness of the filter is therefore no longer mandatory. The ventilator works in this configuration in the same way as a ventilator mounted axially. This embodiment is of reduced bulk, has a minimum number of parts and thus a low mass easily borne by the wearer.

When filtration system 4, 5 is saturated, it must be replaced. This operation is carried out with the ventilation device according to the invention at the workplace or in the contaminated area without the face mask having to be removed and whilst continuing to provide protection. To do this, the user must hold his breath to remove the ventilation, replace the filter and restart the ventilation. The duration of these operations with the system according to the invention is less than 10 s. as the user does not have to act on the ventilation device itself.

The device according to the invention can be used indifferently with particle filters, anti-gas filters or combined filters; the dimensions of the fan wheel and the motor can be adapted according to the air flow and the overpressure required to be obtained at the air filter outlet.

I claim:

1. An overpressure ventilation device for a gas mask air filter integrated into a case closed by a lid, said device formed of a caseless centrifugal ventilator comprising a motor having a shaft, a ventilator fan wheel, and a connection means for said case closed by a lid, said ventilator being connected upstream of the filter, said device further comprising a support integral with the filter lid enabling the motor and ventilator fan wheel to be centered on the longitudinal axis of the filter, such as to obtain the axial operation of said ventilator, said lid being provided with a well in which to receive said support, said well comprising a first lateral wall cooperating with said connection means, a second lateral wall prolonging said first wall and a bottom wall provided with outlet apertures to let the air through.

2. A ventilation device according to claim 1, wherein strips are fastened to said second lateral wall and to said bottom wall to channel the air towards said outlet apertures.

3. A ventilation device according to claim 2, wherein said support is formed of a cap to center said motor fitted in a removable manner onto said lid.

4. A ventilation device according to claim 3, further comprising a deflector placed between said support and said fan wheel and wherein said fan wheel has blades extending from the fan wheel.

5. A ventilation device according to claim 3, wherein said cap is in the shape of a substantially cylindrical element prolonged by a lateral wall of the cap fitted with means to connect it to said lid.

6. A ventilation device according to claim 4, wherein said cap is in the shape of a substantially cylindrical element prolonged by a lateral wall of the cap fitted with means to connect it to said lid.

7. A ventilation device according to claim 6, wherein said lateral wall of the cap is fitted with air inlets and is prolonged on the inside by a fold marking out said deflector.

8. A ventilation device according to claim 4, further comprising:

a first chamber marked out by said lateral wall of said cap and said deflector, a second chamber marked out by said motor and the blades of said ventilator fan wheel, and a third chamber marked out by said deflector, said lid and said ventilator fan wheel.

9. A ventilation device according to claim 6, wherein said lateral wall of said cap and said deflector mark out an observation window for said fan wheel.

10. A ventilation device according to claim 1, wherein said fan wheel has a lower edge that is fastened rigidly to the shaft of said motor which is supported by a bearing, said shaft being aligned along axis B of the filter.

* * * * *